US007040223B2

(12) United States Patent
Arai et al.

(10) Patent No.: US 7,040,223 B2
(45) Date of Patent: May 9, 2006

(54) STENCIL PRINTING INK CONTAINER, STENCIL PRINTING INK CARTRIDGE, METHOD OF MANUFACTURING THE INK CARTRIDGE, AND INNER PLUG FOR THE INK CONTAINER

(75) Inventors: Masakatsu Arai, Ibaraki-ken (JP); Kaoru Kimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/754,707

(22) Filed: Jan. 12, 2004

(65) Prior Publication Data

US 2004/0139868 A1 Jul. 22, 2004

(30) Foreign Application Priority Data

Jan. 14, 2003 (JP) ..... 2003-005895
Oct. 15, 2003 (JP) ..... 2003-355329

(51) Int. Cl.
*B65D 47/02* (2006.01)

(52) U.S. Cl. ..... 101/124; 101/202; 101/327; 222/147; 222/324; 222/372; 222/375

(58) Field of Classification Search ..... 101/114, 101/119, 120, 123, 124, 129, 327, 202; 347/85, 347/86; 222/147, 324, 372, 375
See application file for complete search history.

(56) References Cited

U.S. PATENT DOCUMENTS 5,373,969 A * 12/1994 Takemura ..... 222/147
6,192,797 B1 * 2/2001 Rea et al. ..... 101/202
2001/0003953 A1 * 6/2001 Wakayama et al. ..... 101/119

FOREIGN PATENT DOCUMENTS

JP 2000-272097 A 10/2000
JP 2003-318288 A 11/2000
JP 2002-337895 11/2002

* cited by examiner

*Primary Examiner*—Andrew H. Hirshfeld
*Assistant Examiner*—Kevin D. Williams
(74) *Attorney, Agent, or Firm*—Frommer, Lawrence & Haug, LLP; Matthew K. Ryan, Esq.

(57) ABSTRACT

A stencil printing ink container includes an ink container body. An ink charge port is provided in an end wall of the ink container body and an inner plug is mounted on the ink charge port. The inner plug is provided with an ink discharge port smaller in the outer diameter than the inner diameter of the ink charge port and gives an ink suction nozzle of an ink pump access to the ink discharge port.

12 Claims, 6 Drawing Sheets

STENCIL PRINTING INK CONTAINER, STENCIL PRINTING INK CARTRIDGE, METHOD OF MANUFACTURING THE INK CARTRIDGE, AND INNER PLUG FOR THE INK CONTAINER

BACKGROUND OF THE INVENTION

1. Field of the Invention

This invention relates to an ink container and an ink cartridge (an ink container filled with ink) for supplying ink to a stencil printer and to a method of manufacturing the ink cartridge. The invention further relates to an inner plug for a stencil printing ink container.

2. Description of the Related Art

There has been known a stencil printer in which print is made by the use of a heat-sensitive stencil. In such a stencil printer, a stencil is made by, for instance, bringing a thermal head having a plurality of fine heater elements arranged in a row into contact with heat-sensitive stencil material with the heater elements selectively energized according to the image to be printed while the stencil material is conveyed by a platen roller or the like, thereby imagewise perforating the stencil material. The stencil thus made is wound around a printing drum and a printing paper is pressed against the stencil by a pressing member such as a press roller so that ink is transferred to the printing paper through the perforations.

In order to make smaller the diameter of the perforations to obtain fine printed images or to make higher the penetration of the ink into the printing papers to increase the printing speed, it is preferred that the ink be lower in viscosity. Especially, by lowering the viscosity of ink in a region where shear rate is not higher than 100 $sec^{-1}$, the ink transferred to the printing papers more quickly penetrates into the printing papers and printings free from offset can be obtained.

As a means for supplying ink to the stencil printer, there has been employed a mechanism comprising an ink supply roller which is supported for revolution about its axis by a pair of opposed plate, a distributor which supplies ink onto the ink supply roller and a doctor roller which is disposed spaced from the ink supply roller to control the thickness of ink film formed on the roller. As the distributor, those comprising a tubular member provided with a plurality of small holes or comprising a plurality of nozzles have been known. Ink in an ink container is sucked by an ink pump and is supplied onto the ink supply rollers in the form of drops through the distributor so that an ink fountain is formed in the wedge-like space between the ink supply roller and the doctor roller. Ink in the ink fountain is supplied into the printing drum through the gap between the ink supply roller and the doctor roller. A predetermined amount of ink is constantly held in the ink fountain so that ink can be uniformly supplied.

W/O type emulsion ink containing an oil phase in 10 to 50 wt % and a water phase in 90 to 50 wt % is generally employed in the stencil printer. If the stencil printer is kept unused for a long time, the ink remaining in the ink fountain is exposed to air and the water content therein evaporates, whereby ink high in pigment concentration and accordingly low in viscosity remains in the ink fountain. When new ink is supplied to the ink fountain in which such ink high in pigment concentration and low in viscosity remains, the new ink does not readily mix with the remaining ink and an unevenness in density can occur in the printings. Such an unevenness in density is more serious in ink which is high in viscosity in a region where the shear rate is not higher than 100 $sec^{-1}$.

As the ink container employed in the stencil printer, there have been known, for instance, an ink container comprising an outer box formed of corrugated board and a flexible inner bag accommodated in the outer box so that an ink discharge pipe formed on one end of the inner bag projecting outside the outer box with the outer end thereof closely sealed with a cap (will be referred to as "a BIC-type ink container", hereinbelow).

However, the BIC-type ink container is disadvantageous in that if ink which is relatively low in viscosity in the above identified region is charged in the ink container, the ink can be discharged through the ink discharge port (provided on the outer end of the ink discharge pipe) to contaminate user's hand and/or wear, the internal part of the stencil printer, the floor on which the stencil printer is installed and/or the like when the user holds the ink container with the ink discharge port directed downward and the cap removed.

In order to overcome this problem, there has been proposed, in Japanese Unexamined Patent Publication No. 2000-318288 (will be referred to as "patent publication 1", hereinbelow. ), an ink container provided in the ink discharge port with a valve which is opened in response to loading the ink container onto a printer.

Further, Japanese Unexamined Patent Publication No. 2000-272097 (will be referred to as "patent publication 2", hereinbelow.) discloses a method of loading an ink container onto a printer in which an ink container is loaded onto a printer with the ink discharge port directed upward so that the user do not direct the ink discharge port downward with the ink discharge port opened.

Further, there has been known an ink container comprising a cylinder provided with an ink discharge port on the front thereof and a piston inserted into the cylinder (will be referred to as "a piston-type ink container", hereinbelow). The piston-type ink container is advantageous over the BIC-type ink container in that the amount of ink remaining in. the ink container after ink is sucked to the very end is smaller and ink can be effectively used. In this ink container, the ink discharge port is sealed by a cap which is screwed on the ink discharge port. When using the ink container, the cap is unscrewed and the ink container is inserted into the stencil printer from the container holder of the stencil printer so that the ink suction port of the stencil printer is fitted with the ink discharge port of the ink container.

However, the ink container proposed in "patent publication 1" is disadvantageous in that the valve provided in the ink discharge port is apt to be damaged since it is arranged by precise and delicate components, and that the number of components increases to add to the cost.

Further, the method disclosed in "patent publication 2" can only be applied to ink containers of a limited size. Further, the ink container used in the stencil printer is required to accommodate a relatively large volume of ink, 500 ml to 1500 ml, since the stencil printer is suitable for making a relatively large number of copies from one original and the ink container for the stencil printer has been designed on the assumption that a larger amount of ink is consumed in a short time as compared with general office appliances, and accordingly, the method disclosed in "patent publication 2" cannot be satisfactory unless the diameter and/or length of the drum are greatly enlarged.

In ink containers for stencil printers, it is preferred that the ink discharge port be as small as possible in order to prevent ink low in viscosity from dripping from the ink discharge port when mounting the ink container on the stencil printer or removing the ink container from the stencil printer. At the same time, it is necessary for the ink discharge port to be provided with a means for giving the ink suction nozzle of the stencil printer easy access thereto.

On the other hand, it is preferred that the ink charge port of the ink container be as large as possible from the viewpoint of ensuring high charging efficiency.

SUMMARY OF THE INVENTION

In view of the foregoing observations and description, the primary object of the present invention is to provide an ink container and an ink cartridge for supplying ink to a stencil printer and to a method of manufacturing the ink cartridge, which make it feasible to charge ink at high charging efficiency, and to prevent even ink low in viscosity from dripping from the ink discharge port when mounting the ink container on the stencil printer or removing the ink container from the stencil printer.

Another object of the present invention is to provide an inner plug suitable for mounting on a stencil printing ink container.

In accordance with a first aspect of the present invention, there is provided a stencil printing ink container comprising an ink container body, an ink charge port provided in an end wall of the ink container body, and an inner plug which is provided with an ink discharge port smaller in the outer diameter than the inner diameter of the ink charge port and a means for giving an ink suction nozzle of an ink pump access to the ink discharge port and is mounted on the ink charge port.

The "means for giving an ink suction nozzle of an ink pump access to the ink discharge port" is, for instance, a support portion which supports the suction nozzle with the suction nozzle and the ink discharge portion kept communicated with each other.

For example, the means for giving an ink suction nozzle of an ink pump access to the ink discharge port may be a cylindrical portion which is provided with said ink discharge port on its front end and is engaged with and disengaged from the suction nozzle by pushing toward and pulling away from the suction nozzle.

In this case, it is preferred that the inner plug be further provided with a means for keeping liquid-tightness to the ink charge port, and a draw-resistant means which is resistive to draw of the inner plug from the ink charge port and provides strength of engagement between the inner plug and the ink charge port withstanding pulling force acting when the ink discharge port is pulled away from the suction nozzle to be disengaged therefrom.

When the ink container body is provided with a guide cylinder which projects outward from the end wall around the ink charge port, the means for keeping liquid-tightness to the ink charge port may be an elastic annular member which is provided on the peripheral surface of the inner plug integrally therewith to be press-fitted on the inner peripheral surface in a liquid-tight fashion.

The draw-resistant means of the inner plug preferably comprises an elastic hook engaged with the peripheral edge of the ink charge port.

In accordance with a second aspect of the present invention, there is provided a stencil printing ink cartridge comprising a stencil printing ink container having an ink container body, an ink charge port provided in an end wall of the ink container body, an inner plug which is provided with an ink discharge port smaller in the outer diameter than the inner diameter of the ink charge port and a means for giving an ink suction nozzle of an ink pump access to the ink discharge port and is mounted on the ink charge port, and ink filled in the ink container body.

In accordance with a third aspect of the present invention, there is provided a method of manufacturing an ink cartridge comprising the steps of filling stencil printing ink in a stencil printing ink container having an ink container body and an ink charge port provided in an end wall of the ink container body through the ink charge port, and mounting an inner plug, which is provided with an ink discharge port smaller in the outer diameter than the inner diameter of the ink charge port and a means for giving an ink suction nozzle of an ink pump access to the ink discharge port, on the inside of the ink charge port filled with ink.

In accordance with a fourth aspect of the present invention, there is provided an inner plug which is press-fitted on an ink charge port of an ink container body of a stencil printing ink container and is provided with an ink discharge port smaller in the outer diameter than the inner diameter of the ink charge port and a means for giving an ink suction nozzle of an ink pump access to the ink discharge port, the inner plug comprising a cylindrical first portion which is larger in outer diameter than the ink charge port, a cylindrical second portion which is smaller in diameter than the first portion, is provided with the ink discharge port on its front end, is coaxially and integrally connected to one end of the first portion, and is permitted to be engaged with and disengaged from the ink suction nozzle by pushing toward and pulling away from the same, and a cylindrical third portion which is provided with a draw-resistant means which is resistive to draw of the second portion of the inner plug from the ink suction nozzle and provides strength of engagement between the inner plug and the ink charge port withstanding pulling force acting when the second portion is pulled away from the suction nozzle to be disengaged therefrom, is coaxially and integrally connected to the other end of the first portion and is press-fitted on the ink charge port of the ink container body.

When the ink container body is provided with a guide cylinder which projects outward from the end wall around the ink charge port, it is preferred that the first portion of the inner plug be disposed coaxially with the guide cylinder inside the same and be provided on its outer peripheral surface with annular elastic member which abuts against the inner peripheral surface of the guide cylinder in a liquid-tight fashion.

Further, it is preferred that the inner diameter of the ink discharge port be set according to the viscosity of the ink so that the ink in the ink container body does not drip from the ink discharge port at least for twenty seconds when changing the ink containers.

Further, it is preferred that the third portion be provided with a hook (a draw-resistant means) on the outer peripheral surface of the peripheral wall portion thereof and the peripheral wall portion be provided with a plurality of slits which extend in the axial direction of the inner plug beyond the hook from the front end of the third portion near to the first portion.

The strength of engagement between the third portion of the inner plug and the ink charge port is preferably set to be not smaller than 50N.

In accordance with the stencil printing ink container or the ink cartridge of the present invention, the ink container (ink cartridge) can be easily mounted on a stencil printer and ink dripping through the ink discharge port when mounting the ink container on the stencil printer or removing the ink container from the stencil printer can be prevented while ensuring high ink charging efficiency. By selecting the diameter of the ink discharge port of the inner plug according to the viscosity of the ink to be accommodated in the ink container, ink dripping through the ink discharge port can be prevented even if the ink to be accommodated in the ink container is low in viscosity.

When the inner plug is further provided with a means for keeping liquid-tightness to the ink charge port, and a draw-resistant means which is resistive to draw of the inner plug from the ink charge port and provides strength of engagement between the inner plug and the ink charge port withstanding pulling force acting when the ink discharge port is pulled away from the suction nozzle to be disengaged therefrom, the ink container (ink cartridge) can perform sufficient functions on the stencil printer.

In accordance with the method of manufacturing the ink cartridge of the present invention, by charging the ink through the ink charge port which is larger in diameter than the ink discharge port prior to mounting the inner plug on the ink charge port, the ink charging speed can be higher than when the ink is charged in the ink container through an ink charge port which is equivalent in inner diameter to the ink discharge port.

In accordance with the inner plug of the present invention, ensuring sealing (liquid-tightness) and anti-draw function can be allotted to the first and third portions, whereby the load when the inner plug is fitted with the ink charge port can be lightened while sealing is ensured and strength of engagement between the inner plug and the ink charge port sufficient to withstand pulling force acting when the ink discharge port is pulled away from the suction nozzle to be disengaged therefrom can be obtained.

When the first portion of the inner plug is provided on its outer peripheral surface with annular elastic member which abuts against the inner peripheral surface of the guide cylinder of the ink container, stabilized sealing performance can be constantly ensured even if the inner plug is swollen with the ink.

Further, when the third portion of the inner plug is forced into the ink charge port, an inclined surface of the hook on the third portion is brought into the edge of the ink charge port. When the peripheral wall portion of the third portion is provided with a plurality of slits which extend in the axial direction of the inner plug beyond the hook from the front end of the third portion near to the first portion, the slits form a plurality of resilient pieces on which the hook is formed and the resilient piece can be easily deformed to permit the hook to clear the edge of the ink charge port. With this arrangement, even if the hook is large in height in order to ensure a sufficient strength of engagement to withstand pulling force acting when the ink discharge port is pulled away from the suction nozzle to be disengaged therefrom, the load when the inner plug is forced into the ink charge port can be lightened.

DESCRIPTION OF THE PREFERRED EMBODIMENTS

Figure 1:
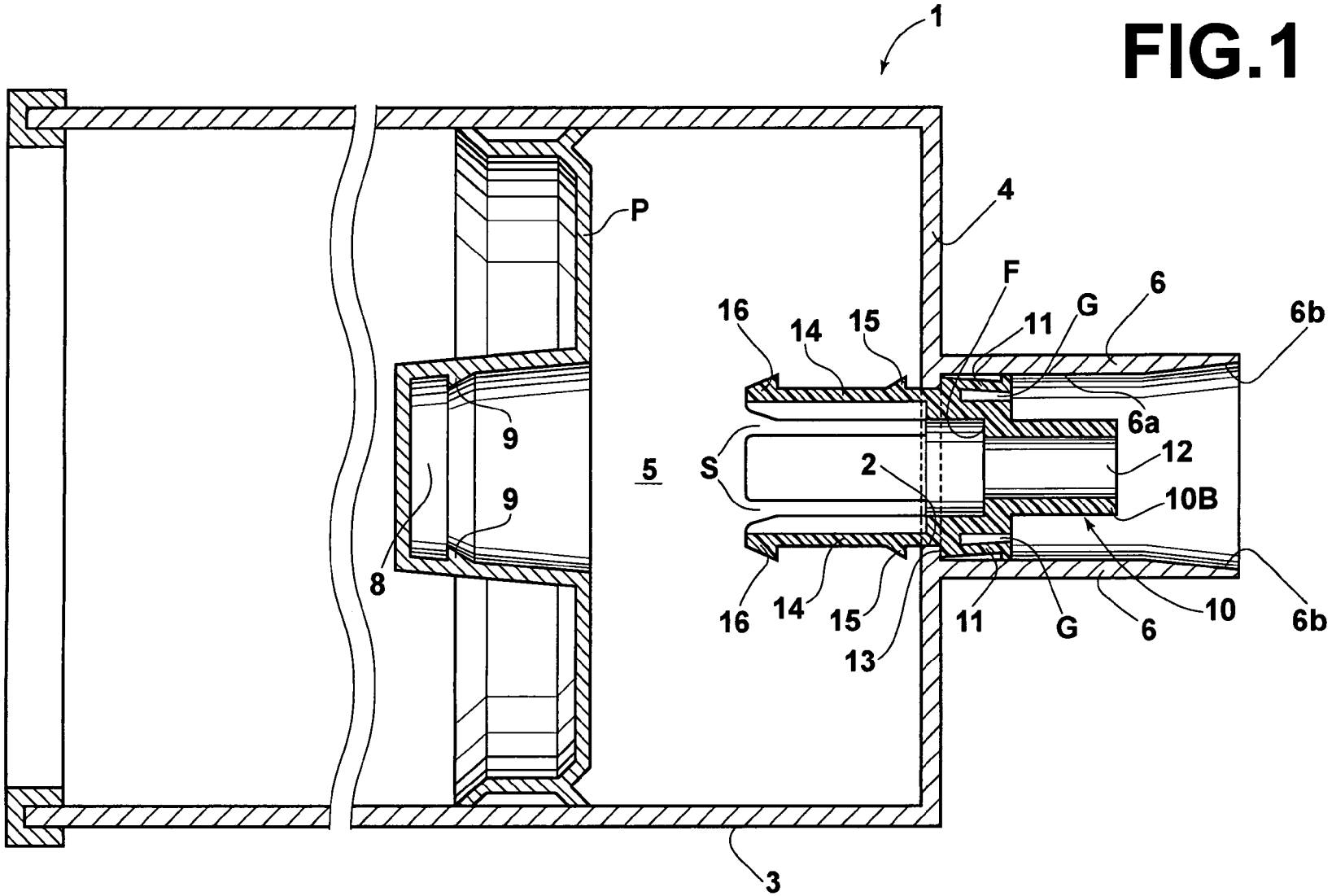
FIG. 1 is a cross-sectional view showing the ink cartridge in accordance with a first embodiment of the present invention where the ink in the ink container is partly consumed but not fully consumed.
Figure 2:
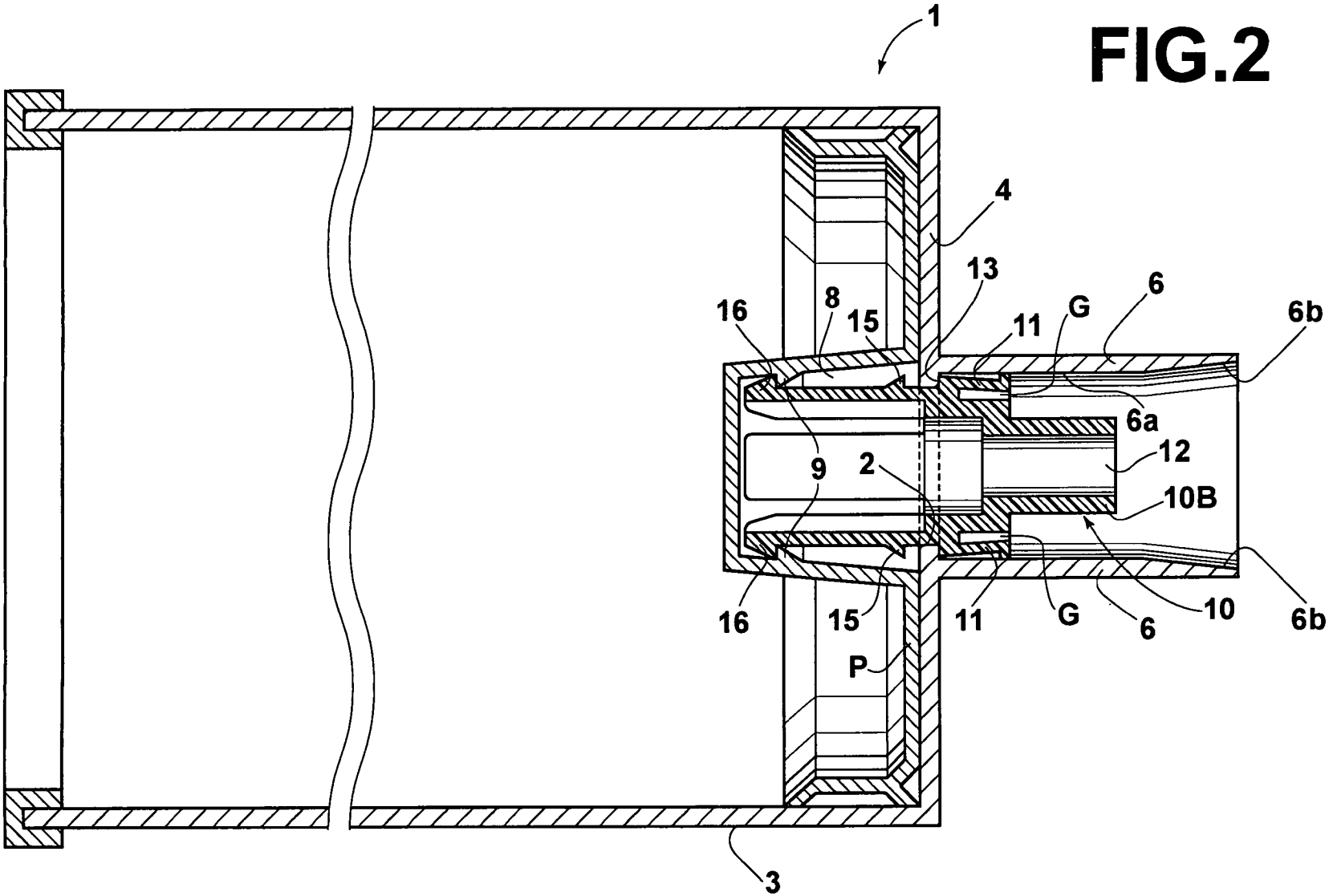
FIG. 2 is a cross-sectional view of the same ink cartridge where the ink is fully consumed.
Figure 3:
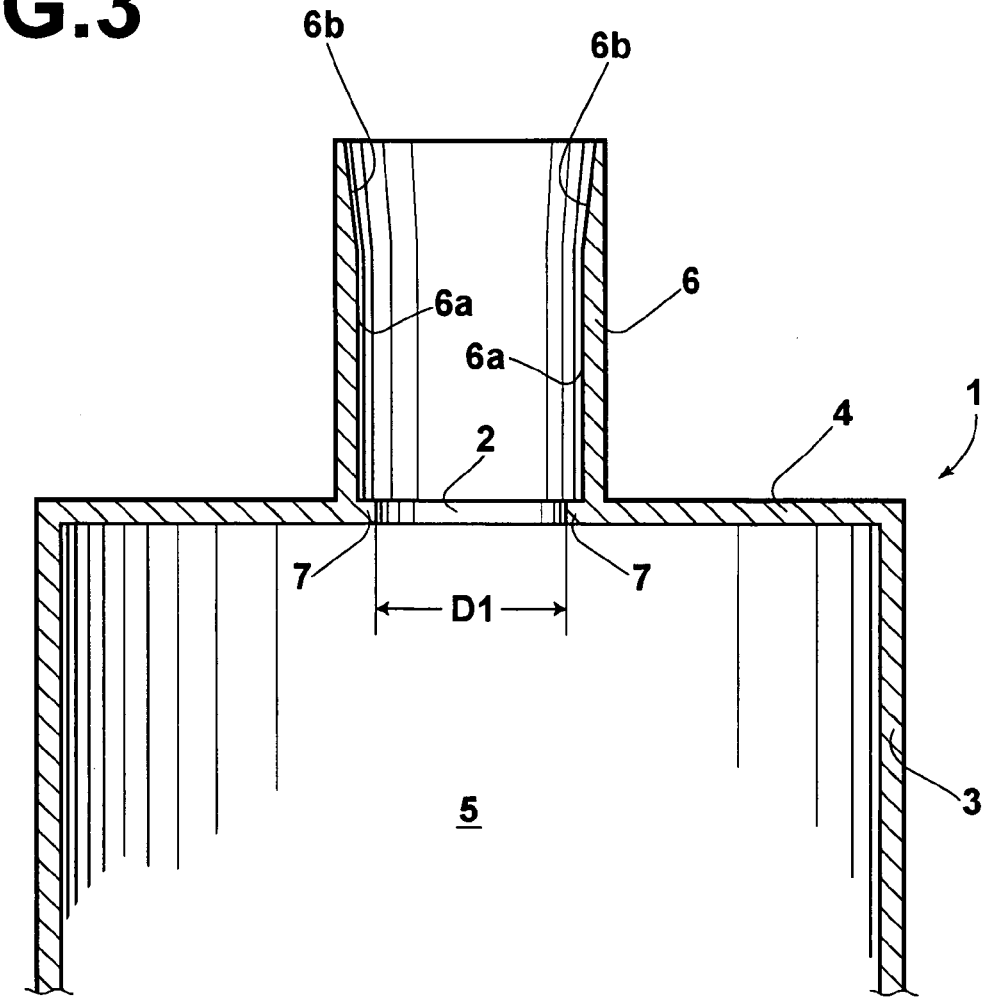
FIG. 3 is a cross-sectional view showing a part of the same ink cartridge near to the ink charge port.

In FIGS. 1 to 3, an ink container body 1 is like a cylinder and comprises a cylindrical side wall 3 closed at one end thereof by an end wall 4, and a piston P which is accommodated in the container body 1 to be slidable in the axial direction of the container body 1. An ink chamber 5 is formed between the end wall 4 and the piston P. A cup-like recess 8 recessed toward the side of the piston 8 opposite to the ink chamber 5 coaxially with the piston 8 is formed in the piston 8 at a central portion thereof. An annular engagement protrusion 9 is formed in the inner peripheral surface of the recess 8 to be continuous in the circumferential direction. As clearly shown in FIG. 1, the engagement protrusion 9 has an inclined surface on the side of the ink chamber 5 and a substantially perpendicular surface on the side remote from the ink chamber 5 and is like a hook in cross section.

Further, as clearly shown in FIG. 3, the ink container body 1 is provided with an ink charge port 2 formed in the end wall 4 and a guide cylinder 6 which projects outward in the axial direction of the ink container body 1 from the end wall 4 around the ink charge port 2 coaxially therewith. The guide cylinder 6 has an inner peripheral surface 6*a* which is larger in inner diameter than inner diameter D1 of the ink charge port 2. The ink charge port 2 has an annular peripheral edge 7 in the end wall 4. Further, the inner peripheral surface 6*a* of the guide cylinder 6 flares toward the tip of the guide cylinder 6 to form a flared inner peripheral surface 6*b*.

Figure 4A:
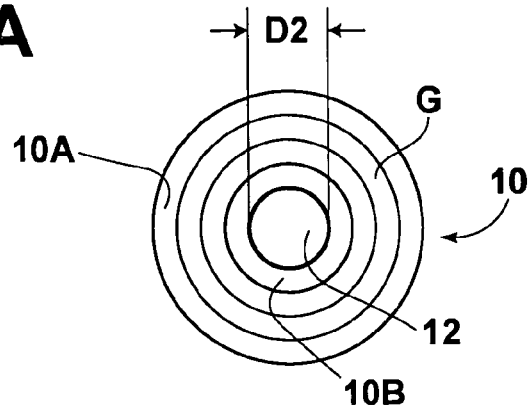
FIG. 4A is a plan view showing the inner plug employed in the ink cartridge shown in FIG. 1.
Figure 4B:
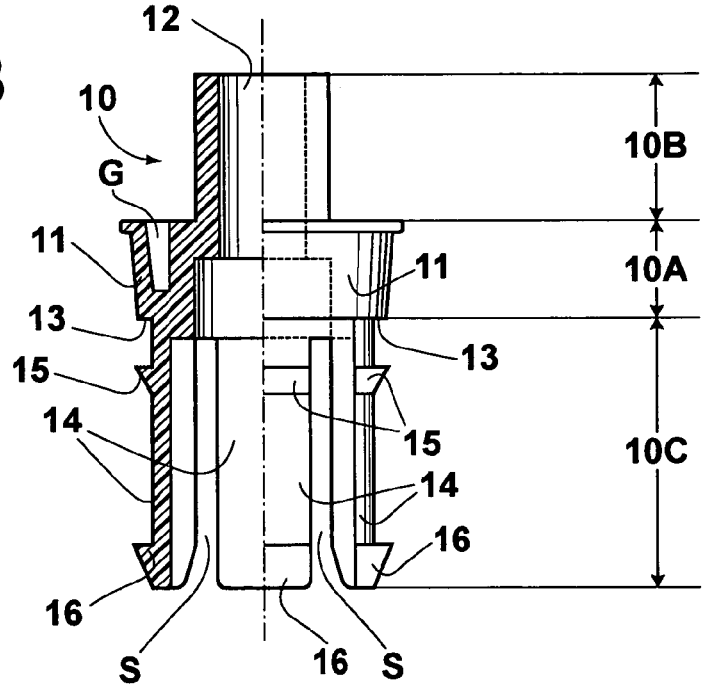
FIG. 4B is a front view partly in cross-section showing the same.
Figure 4C:
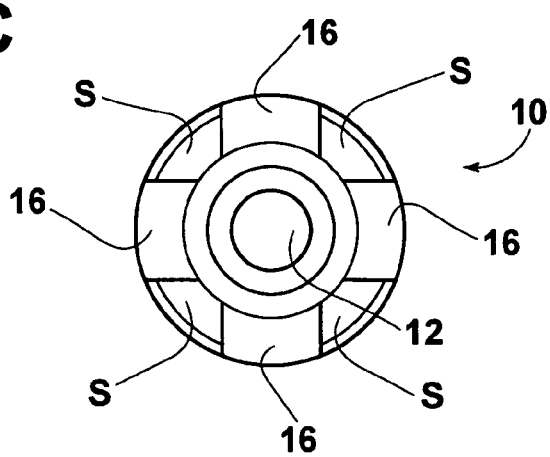
FIG. 4C is a bottom view showing the same.

An inner plug 10 shown in FIGS. 4A to 4C is fitted in the ink charge port 2. The inner plug 10 is hollow and comprises a first portion 10A and second and third portion 10B and 10C connected to the first portion 10A on opposite sides thereof. The first to third portions 10A, 10B and 10C are integrally formed of elastic synthetic resin to be coaxial with each other.

The first portion 10A of the inner plug 10 is larger in diameter than the inner diameter D1 of the ink charge port 2 and is fitted in the inner peripheral surface 6*a* of the guide cylinder 6. An annular groove G is cut in the first portion 10A from the side of the second portion 10B to form a coaxial elastic annular member 11. The free end portion of the elastic annular member 11 is flared outward to have a diameter larger than the inner diameter of the inner peripheral surface 6*a* of the guide cylinder 6 before the first portion 10A is fitted in the inner peripheral surface 6*a* of the guide cylinder 6. When the first portion 10A is fitted in the inner peripheral surface 6*a* of the guide cylinder 6 as shown in FIGS. 1 and 2, the elastic annular member 11 is compressed and is brought into abutment under pressure against the inner peripheral surface 6*a* of the guide cylinder 6 in a liquid-tight fashion.

The second portion 10B of the inner plug 10 is a cylindrical portion which is smaller in outer diameter than the first portion 10A and has an inner diameter D2 smaller than the inner diameter D1 of the ink charge port 2 (about half of D1 in diameter). An ink discharge port 12 opens in the front end face of the second portion 10B. An ink suction nozzle 21 of an ink pump 20 shown in FIG. 5 is fitted on the outer peripheral surface of the second portion 10B.

The third portion 10C of the inner plug 10 is provided with a draw-resistant means like a hook 15 and is press-fitted in the ink charge port 2 of the ink container body 1 to project into the ink chamber 5. The diameter of the third portion 10C is slightly smaller than the inner diameter D1 of the ink charge port 2 except hooks 15 and 16 to be described later so that a shoulder 13 is formed along the boundary of the third portion 10C and the first portion 10A which has a diameter larger than that of the ink charge port 2 and the shoulder 13 abuts against the annular peripheral edge 7 of the ink charge port 2.

The peripheral wall of the third portion 10C is provided with four slits S which extend from the front end substantially to the base end thereof (from the front end of the third portion 10C near to the first portion 10A) in the axial direction of the inner plug 10 at regular angular intervals, whereby four resilient pieces 14 are formed. A hook 15 (a draw-resistant means) is formed on the outer surface of each of the resilient pieces 14. The hooks 15 are formed at a predetermined distance from the shoulder 13 and a recessed portion is formed between the shoulder 13 and the hooks 15 to engage with the annular peripheral edge 7 of the ink charge port 2. A hook 16 is formed also on the outer surface of the free end portion of each resilient piece 14. Each of the hooks 15 and 16 is provided with an inclined surface tapered toward the free end thereof. The surface of each of the hooks 15 and 16 facing the first portion 10A is substantially perpendicular to the longitudinal axis of the inner plug 10.

Figure 5:
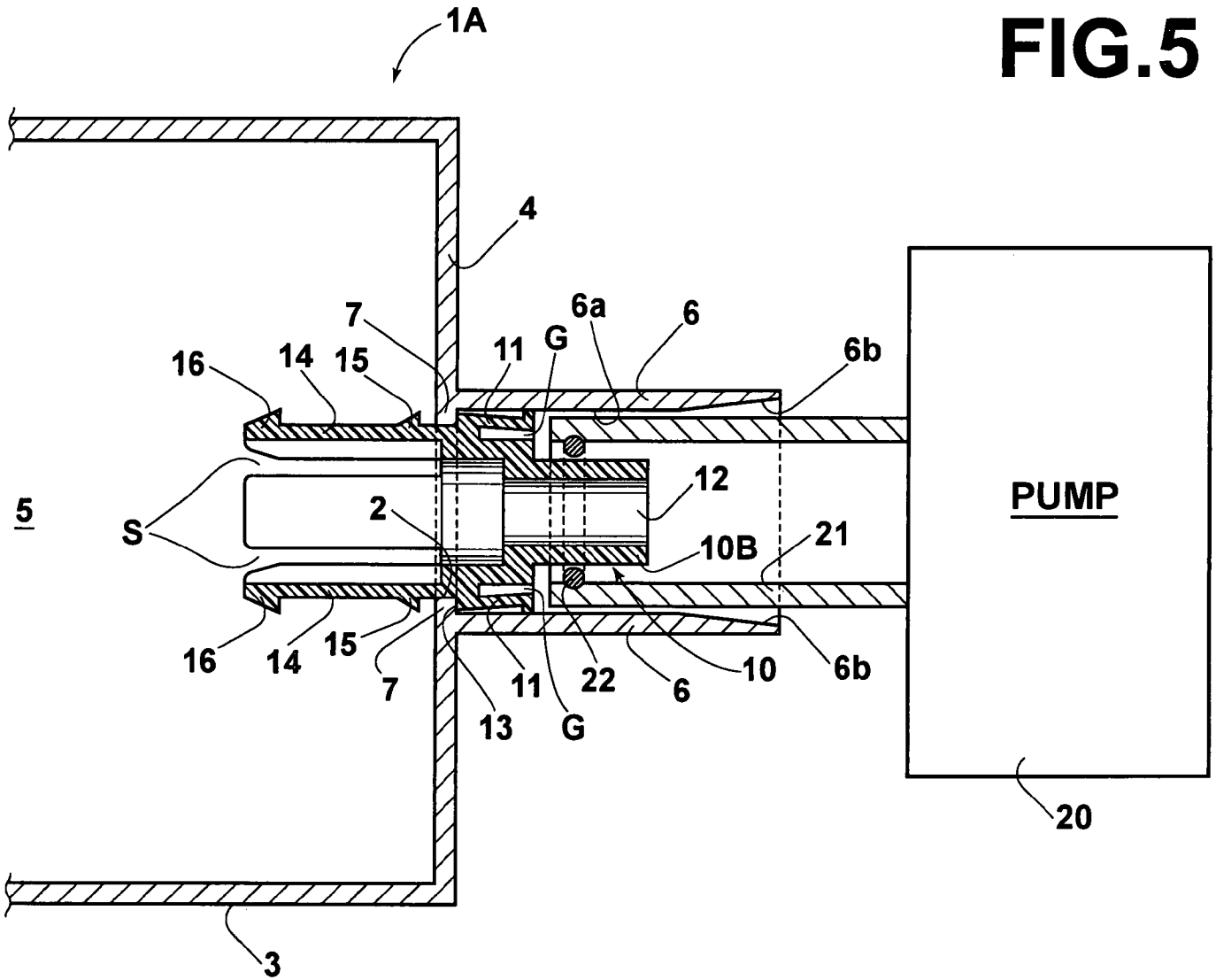
FIG. 5 is a fragmentary cross-sectional view showing a part of the same ink cartridge with the inner plug engaged with the ink suction nozzle of an ink pump.

FIG. 5 is a cross-sectional view showing the ink cartridge (an ink container and ink filled in the ink container) shown in FIGS. 1 and 2 in a state set to the ink pump 20. The ink cartridge is manufactured by mounting the inner plug 10 on the ink charge port 2 of the ink container body 1 after filling the ink in the ink container body 1 through the ink charge port 2.

When mounting the inner plug 10 on the ink charge port 2, the third portion 10C is forced into the ink charge port 2 until the shoulder 13 abuts against the peripheral edge 7 of the ink charge port 2. At this time, though the inclined surfaces of the hooks 15 and 16 on the outer surface of the resilient pieces 14 of the third portion 10C are brought into abutment against the peripheral edge 7 of the ink charge port 2, the resilient pieces 14 are readily deformed inside to permit the hooks 15 and 16 to clear the peripheral edge 7 by virtue of the slits S and the recessed portion between the hooks 15 and the shoulder 13 is brought into engagement with the peripheral edge 7 of the ink charge port 2. Further, the first portion 10A of the inner plug 10 is pressed against the inner peripheral surface 6*a* of the guide cylinder 6 and the elastic annular member 11 is compressed and brought into abutment under pressure against the inner peripheral surface 6*a* of the guide cylinder 6 in a liquid-tight fashion.

The ink pump 20 is provided with the ink suction nozzle 21 which can be inserted between the inner peripheral surface 6*a* of the guide cylinder 6 of the ink container body 1 and the second portion 10B of the inner plug 10 provided with the ink discharge port 12. The ink suction nozzle 21 is fitted on the outer peripheral surface of the second portion 10B of the inner plug 10 under the guidance of the flared inner surface 6*b*. An O-ring 22 on the inner peripheral surface of the ink suction nozzle 21 seals between the ink suction nozzle 21 and the second portion 10B in a liquid-tight fashion.

The ink filled in the ink chamber 5 through the ink charge port 2 before the inner plug 10 is mounted on the ink charge port 2 is sucked by the ink pump 20 with the piston P moved toward the end wall 4 of the ink container body 1 along the side wall 3 thereof.

As the piston P is moved toward the end wall 4 of the ink container body 1, the third portion 10C of the inner plug 10 comes to be inserted into the recess 8 of the piston P and the inclined surfaces of the hooks 16 on the third portion 10C come to abut against the annular engagement protrusion 9 in the recess 8 of the piston P. At this time, the resilient pieces 14 are deformed inside to permit the hooks 16 to clear the annular engagement protrusion 9, thereby permitting the piston P to move toward the end wall 4. At a time the piston P abuts against the end wall 4, that is, when the ink in the ink chamber 5 is almost all consumed, the hooks 16 on the free end portion of the third portion 10C of the inner plug 10 engage with the annular engagement protrusion 9 in the recess 8, thereby holding the piton P.

Then the second portion 10B of the inner plug 10 is drawn out from the ink suction nozzle 21 in order to change the ink cartridges. The material of the inner plug 10, the height of the hooks 15, and the like are selected so that the strength of engagement between the third portion 10C of the inner plug 10 and the ink charge port 2 is not smaller than 50N. With this arrangement, the inner plug 10 cannot be drawn away from the ink container body 1 by the force which pulls rightward (as seen in FIG. 5) the inner plug 10 in response to drawing out the second portion 10B from the ink suction nozzle 21. The strength of engagement between the third portion 10C of the inner plug 10 and the ink charge port 2 is set to be as described above on the basis of the assumption that the hooks 16 are not engaged with the pistons P.

The pulling force acting on the inner plug 10 has been from 15N to 35N when measured in the following manner. That is, an ink container which was 8.0 mm in the outer diameter of the second portion 10B of the inner plug 10 was set to the ink suction nozzle 21 as shown in FIG. 5. The inner diameter of the O-ring 22 in the ink suction nozzle 21 was 7.8 mm. The load (pulling force) acting on the inner plug 20 when the ink container was drawn out from the ink suction nozzle 21 was measured by a push/pull scale (MAX50 kgf, by Imada Seisakusho) connected to the rear end of the ink container. The load was measured with no ink filled in the ink container.

The result of the measurement shows that the strength of engagement between the third portion 10C of the inner plug 10 and the ink charge port 2 is preferably not smaller than 50N.

The strength of engagement between the third portion 10C of the inner plug 10 and the ink charge port 2 was measured by measuring the load necessary to disengage the inner plug 10 from the ink container body 1 when load was applied to a surface F (perpendicular to the longitudinal axis of the ink container body 1) inside the inner plug 10 mounted on the ink container body 1 as shown in FIG. 1. The measurement of the strength of engagement was carried out by the use of an autograph (AGS-500D by SHIMADZU) at a measuring speed of 1000 mm/min.

The inner diameter D2 of the second portion 10B of the inner plug 10 was set according to the viscosity of the ink so that the ink does not drip from the ink discharge port 12 for at least 20 seconds, for instance, when the ink cartridge is changed.

There is fear that the ink drips from the ink discharge port for 10 seconds at most from the time the cap of the ink container is removed to the time the ink cartridge is mounted on the printer. Taking into account this fact, a datum "20 seconds" has been selected on the basis of unaccustomed users. The ink container filled with the ink was held for 20 seconds with the ink discharge port directed downward. Then dripping of the ink was evaluated and the inner diameter D2 of the second portion 10B was set on the basis of the evaluation.

As can be understood from the description above, in accordance with the ink cartridge (ink container) of this embodiment, ink dripping through the ink discharge port 12 when mounting the ink cartridge on the stencil printer or removing the ink cartridge from the stencil printer can be prevented while ensuring high ink charging efficiency to the ink container body 1. By selecting the diameter of the ink discharge port 12 of the inner plug 10 according to the viscosity of the ink to be accommodated in the ink container body 1, ink dripping through the ink discharge port 12 can be prevented even if the ink to be accommodated in the ink container body 1 is low in viscosity.

Further, in accordance with the inner plug 10 employed in the ink cartridge of this embodiment, since ensuring sealing (liquid-tightness) and securing anti-draw function are allotted to the first and third portions 10A and 10C, the load when the inner plug 10 is fitted with the ink charge port 2 can be lightened while sealing is ensured and strength of engagement between the inner plug 10 and the ink charge port 2 sufficient to withstand pulling force acting when the ink discharge port 12 is pulled away from the suction nozzle 21 to be disengaged therefrom can be obtained.

That is, since the outer peripheral portion of the first portion 10A forms an elastic annular member 11 which is larger in diameter than the inner diameter of the inner peripheral surface 6*a* of the guide cylinder 6 before pressed against the inner peripheral surface 6*a*, stabilized sealing performance can be constantly ensured even if the inner plug 10 is swollen and/or bulged. Further since being readily deformed, the elastic annular member 11 cannot form load when the inner plug 10 is forced into the ink charge port 2.

Further, since the hooks 15 and 16 are formed on four resilient pieces 14 which are formed by slits S extending in the axial direction of the inner plug 10 beyond the hook 15 from the front end of the third portion 10C near to the first portion 10A and are readily deformed, the hooks 15 and 16 are permitted to clear the edge 7 of the ink charge port 2 by deformation of the resilient pieces 14 when the inner plug 10 is to be press-fitted in the ink charge port 2 and the hooks 15 and 16 come to abut against the edge 7 of the ink charge port 2, whereby the load when the inner plug 10 is forced into the ink charge port 2 can be lightened even if the hooks 15 are large in height in order to ensure a sufficient strength of engagement to withstand pulling force acting when the ink discharge port 12 is pulled away from the suction nozzle 21 to be disengaged therefrom.

Figure 6A:
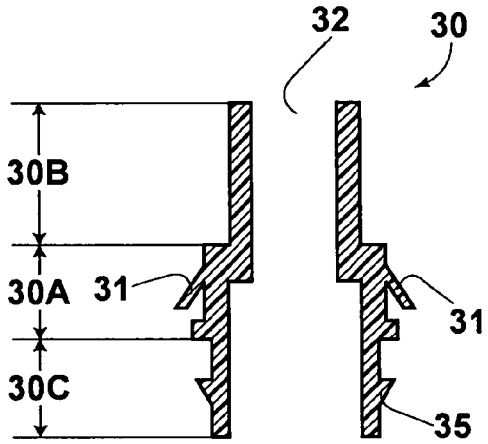
FIGS. 6A to 6C are views respectively illustrating inner plugs in accordance with other embodiments of the present invention.
Figure 6B:
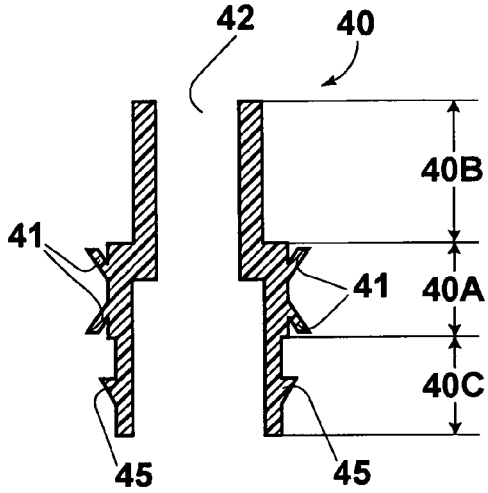
Figure 6C:
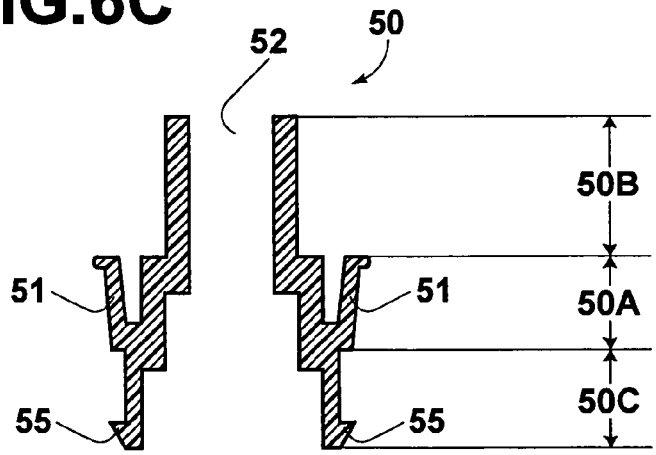

The inner plug need not be provided with the hooks to be engaged with the piston as shown in FIGS. 6A to 6C. Each of the inner plugs 30, 40 and 50 respectively shown in FIGS. 6A to 6C comprises a first portion 30A, 40A or 50A provided with an elastic annular member 31, 41 or 51, a cylindrical second portion 30B, 40B or 50B provided with an ink discharge port 32, 42 or 52, and a third portion 30C, 40C or 50C provided with hooks 35, 45 or 55 and slits S. In the inner plugs 30 and 40 shown in FIGS. 6A and 6B, the annular member 31 and 41 differ in shape from that of the inner plug 10 described above. The inner plug 50 shown in FIG. 6C is substantially the same as the inner plug 10 described above except that the hooks to be engaged with the piston are eliminated and the resilient pieces 55 are shorter than that of the inner plug 10 described above.

By providing short tubular portions below the hooks 35, 45 or 55 of the third portion 30C, 40C or 50C, the inner plugs 30, 40 and 50 can be more stably forced into the ink container body 1.

Though the whole of the inner plug 10, 30,40 or 50 may be formed of elastic synthetic resin, only the first portion 10A, 30A, 40A or 50A may be formed of elastic material.

What is claimed is:

1. A stencil printing ink container for supplying ink to an ink pump through an ink suction nozzle of said ink pump comprising:

an ink container body, an ink charge port provided in an end wall of the ink container body, and an inner plug comprising (i) an ink discharge port having an outer diameter which is smaller than the inner diameter of the ink charge port and (ii) a means for giving said ink suction nozzle access to the ink discharge port, said inner plug being mounted on the ink charge port;

wherein said means for giving said ink suction nozzle access to the ink discharge port includes a portion of said plug extending inside said ink suction nozzle.

2. A stencil printing ink container as defined in claim 1 in which the means for giving an ink suction nozzle of an ink pump access to the ink discharge port comprises a cylindrical portion which includes said ink discharge port on its front end and wherein said means for giving an ink suction nozzle of an ink pump access to the ink discharge port is engaged with and disengaged from the suction nozzle by pushing toward and pulling away from the suction nozzle.

3. A stencil printing ink container as defined in claim 2 in which the inner plug further comprises a means for keeping liquid-tightness to the ink charge port, and a draw-resistant means which is resistive to draw of the inner plug from the ink charge port and provides strength of engagement between the inner plug and the ink charge port withstanding pulling force acting when the ink discharge port is pulled away from the suction nozzle to be disengaged therefrom.

4. A stencil printing ink container as defined in claim 3 in which the ink container body includes a guide cylinder which projects outward from the end wall around the ink charge port and the means for keeping liquid-tightness to the ink charge port comprises an elastic annular member which is provided on the peripheral surface of the inner plug integrally therewith to be press-fitted on the inner peripheral of said guide cylinder surface in a liquid-tight fashion.

5. A stencil printing ink container as defined in claim 4 in which the draw-resistant means of the inner plug comprises an elastic hook engaged with the peripheral edge of the ink charge port.

6. A stencil printing ink container as defined in claim 3 in which the draw-resistant means of the inner plug comprises an elastic hook engaged with the peripheral edge of the ink charge port.

7. A stencil printing ink cartridge comprising:

an ink container body, an ink charge port provided in an end wall of the ink container body, an inner plug comprising (i) an ink discharge port having an outer diameter which is smaller than the inner diameter of the ink charge port and (ii) a means for giving an ink suction nozzle of an ink pump access to the ink discharge port said inner plug being mounted on the ink charge port, and an ink filled in the ink container body;

wherein said means for giving an ink suction nozzle of an ink pump access to the ink discharge port includes a portion for fitting inside said ink suction nozzle.

8. A method of manufacturing an ink cartridge comprising the steps of filling stencil printing ink in a stencil printing ink container having an ink container body and an ink charge port provided in an end wall of the ink container body through the ink charge port, and after filling said ink container body with said stencil printing ink, mounting an inner plug, which comprises an ink discharge port smaller in the outer diameter than the inner diameter of the ink charge port and a means for giving an ink suction nozzle of an ink pump access to the ink discharge port, on the ink charge port, said means extending inside said ink suction nozzle.

9. A stencil printing ink container as defined in claim 4 in which said guide cylinder includes an inner peripheral surface which flares outward at an outer end of said guide cylinder.

10. A stencil printing ink container for supplying ink to an ink pump through an ink suction nozzle comprising:

an ink container body, an ink charge port provided in an end wall of the ink container body, and an inner plug comprising an ink discharge port smaller in the outer diameter than the inner diameter of the ink charge port and said inner plug further comprising a portion extending inside said ink suction nozzle, said inner plug being mounted on the ink charge port.

11. A stencil printing ink container for supplying ink to an ink pump through an ink suction nozzle of said ink pump comprising:

an ink container body, an ink charge port provided in an end wall of the ink container body, and an inner plug comprising (i) an ink discharge port having an outer diameter which is smaller than the inner diameter of the ink charge port and (ii) a means for giving said ink suction nozzle access to the ink discharge port;

wherein said inner plug is removably mounted on the ink charge port so that said inner plug is removed from said ink charge port when stencil printing ink is charged to said ink container body, and is inserted into said ink charge port when the ink is supplied to said ink pump through said inner plug and said ink suction nozzle.

12. A stencil printing ink cartridge comprising:

an ink container body, an ink charge port provided in an end wall of the ink container body, an inner plug comprising (i) an ink discharge port having an outer diameter which is smaller than the inner diameter of the ink charge port and (ii) a means for giving an ink suction nozzle of an ink pump access to the ink discharge port, and an ink filled in the ink container body;

wherein said inner plug is removably mounted on the ink charge port so that said inner plug is removed from said ink charge port when said ink is charged to said ink container body, and is inserted into said ink charge port when said ink is supplied to said ink pump through said inner plug and said ink suction nozzle.

* * * * *